US010062483B2

(12) United States Patent
Inoue et al.

(10) Patent No.: US 10,062,483 B2
(45) **Date of Patent: *Aug. 28, 2018**

(54) GRAIN-ORIENTED ELECTRICAL STEEL SHEET AND METHOD FOR IMPROVING IRON LOSS PROPERTIES THEREOF

(71) Applicant: JFE Steel Corporation, Tokyo (JP)

(72) Inventors: Hirotaka Inoue, Tokyo (JP); Shigehiro Takajo, Tokyo (JP); Hiroi Yamaguchi, Tokyo (JP); Seiji Okabe, Tokyo (JP); Kazuhiro Hanazawa, Tokyo (JP)

(73) Assignee: JFE Steel Corporation (JP)

( * ) Notice: Subject to any disclaimer, the term of this patent is extended or adjusted under 35 U.S.C. 154(b) by 461 days.

This patent is subject to a terminal disclaimer.

(21) Appl. No.: 14/368,975

(22) PCT Filed: Dec. 27, 2012

(86) PCT No.: PCT/JP2012/008411

§ 371 (c)(1),
(2) Date: Jun. 26, 2014

(87) PCT Pub. No.: WO2013/099274

PCT Pub. Date: Jul. 4, 2013

(65) Prior Publication Data

US 2015/0132547 A1 May 14, 2015

(30) Foreign Application Priority Data

Dec. 28, 2011 (JP) ..... 2011-289914

(51) Int. Cl.
*H01F 1/18* (2006.01)
*C21D 6/00* (2006.01)
(Continued)

(52) U.S. Cl.
CPC ..... *H01F 1/18* (2013.01); *C21D 1/38* (2013.01); *C21D 6/001* (2013.01); *C21D 6/005* (2013.01);
(Continued)

(58) Field of Classification Search
None
See application file for complete search history.

(56) References Cited

U.S. PATENT DOCUMENTS 6,280,862 B1 * 8/2001 Inokuti ..... C21D 8/1288 148/110
2005/0126659 A1 * 6/2005 Homma ..... C22C 38/02 148/111
(Continued)

FOREIGN PATENT DOCUMENTS

EP 1 227 163 7/2002
EP 2 602 343 6/2013
(Continued)

OTHER PUBLICATIONS

Notice of Grounds for Rejection dated May 20, 2015 of corresponding Korean Application No. 2014-7018758 along with its English translation.
(Continued)

*Primary Examiner* — Vera Katz
(74) *Attorney, Agent, or Firm* — DLA Piper LLP (US)

(57) ABSTRACT

A grain-oriented electrical steel sheet, on which magnetic domain refining treatment by strain application has been performed, has an insulating coating with excellent insulation properties and corrosion resistance. The grain-oriented electrical steel sheet is obtained by irradiating a steel sheet with a high-energy beam to apply, to the steel sheet, linear strain extending in a direction that intersects a rolling direction of the steel sheet, and then re-forming an insulating
(Continued)

coating on the steel sheet, in which in an irradiation mark region due to the high-energy beam, a ratio of an area containing defects on the insulating coating is 40% or less, a maximum width of the irradiation mark region in the rolling direction is 250 μm or less, and a thickness of the insulating coating is 0.3 μm or more and 2.0 μm or less.

3 Claims, 1 Drawing Sheet

(51) Int. Cl.

| | |
|---|---|
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/60*** | (2006.01) |
| ***C23F 17/00*** | (2006.01) |
| ***H01F 41/02*** | (2006.01) |
| ***C23C 22/74*** | (2006.01) |
| ***C21D 1/38*** | (2006.01) |
| ***C23C 8/50*** | (2006.01) |
| ***C23C 8/80*** | (2006.01) |

(52) U.S. Cl.

CPC ..... *C21D 6/008* (2013.01); *C21D 8/12* (2013.01); *C21D 8/1255* (2013.01); *C21D 8/1272* (2013.01); *C21D 8/1283* (2013.01); *C21D 8/1294* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/08* (2013.01); *C22C 38/60* (2013.01); *C23C 8/50* (2013.01); *C23C 8/80* (2013.01); *C23C 22/74* (2013.01); *C23F 17/00* (2013.01); *H01F 41/02* (2013.01); *Y10T 428/24851* (2015.01)

(56) References Cited

U.S. PATENT DOCUMENTS

| | | | | |
|---|---|---|---|---|
| 2013/0206283 | A1* | 8/2013 | Inoue | C21D 1/38 148/108 |
| 2014/0234638 | A1* | 8/2014 | Takajo | B21B 3/02 428/450 |
| 2014/0360629 | A1* | 12/2014 | Inoue | C22C 38/001 148/111 |
| 2015/0010762 | A1* | 1/2015 | Yamaguchi | C22C 38/001 428/471 |

FOREIGN PATENT DOCUMENTS

| | | |
|---|---|---|
| JP | 57-2252 | 1/1982 |
| JP | 57-152423 | 9/1982 |
| JP | 59-229419 | 12/1984 |
| JP | 62-49322 | 10/1987 |
| JP | 3-130377 | 6/1991 |
| JP | 4-337079 | 11/1992 |
| JP | 5-1387 | 1/1993 |
| JP | 5-43945 | 2/1993 |
| JP | 5-32881 | 5/1993 |
| JP | 5-195239 | 8/1993 |
| JP | 6-2042 | 1/1994 |
| JP | 6-72266 | 9/1994 |
| JP | 7-336969 | 12/1995 |
| JP | 2001-303214 | 10/2001 |
| JP | 3361709 | 1/2003 |
| JP | 4091749 | 5/2008 |
| KR | 2002-0089370 | 11/2002 |
| KR | 10-0561142 | 3/2006 |

OTHER PUBLICATIONS

Chinese Office Action dated Jun. 30, 2015 of corresponding Chinese Application No. 201280065047.5 along with its English translation.
European Supplementary Search Report dated Jul. 16, 2015 of corresponding European Application No. 12861065.6.
English Translation of Notice of Reasons for Rejection of Patent Application No. JP 2013-527810 dated Aug. 13, 2013.
English Translation of Notice of Reasons for Rejection of Patent Application No. JP 2013-527810 dated Dec. 24, 2013.
Office Action dated Nov. 9, 2015 of corresponding Russian Application No. 2014131023 along with an English translation.

* cited by examiner (a)
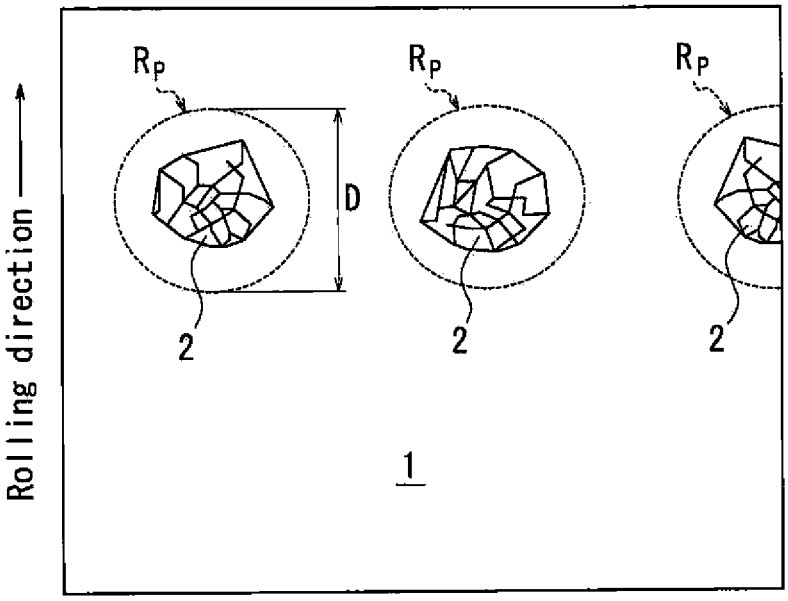
(b)
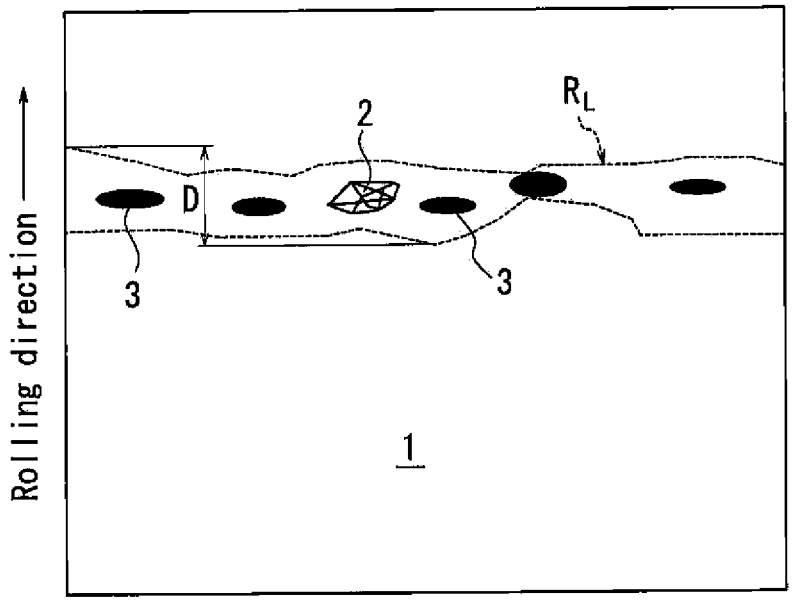

GRAIN-ORIENTED ELECTRICAL STEEL SHEET AND METHOD FOR IMPROVING IRON LOSS PROPERTIES THEREOF

TECHNICAL FIELD

This disclosure relates to a grain-oriented electrical steel sheet advantageously utilized for an iron core of a transformer or the like.

BACKGROUND

A grain-oriented electrical steel sheet is mainly utilized as an iron core of a transformer and is required to exhibit superior magnetization characteristics, in particular low iron loss.

In this regard, it is important to highly accord secondary recrystallized grains of a steel sheet with (110)[001] orientation, i.e. the "Goss orientation", and reduce impurities in a product steel sheet. Furthermore, since there are limits on controlling crystal grain orientations and reducing impurities, a technique has been developed to introduce non-uniformity into a surface of a steel sheet by physical means to subdivide the width of a magnetic domain to reduce iron loss, i.e. a magnetic domain refining technique.

For example, JP S57-2252 B2 proposes a technique of irradiating a steel sheet as a finished product with a laser to introduce high-dislocation density regions into a surface layer of the steel sheet, thereby narrowing magnetic domain widths and reducing iron loss of the steel sheet. Furthermore, JP H6-072266 B2 proposes a technique to control the magnetic domain width by electron beam irradiation.

Thermal strain application-based magnetic domain refinement techniques such as laser beam irradiation and electron beam irradiation have the problem that an insulating coating on the steel sheet is damaged by sudden and local thermal application, causing the insulation properties such as interlaminar resistance and withstand voltage, as well as corrosion resistance, to worsen. Therefore, after laser beam irradiation or electron beam irradiation, re-forming is performed on the steel sheet by applying an insulating coating again to the steel sheet and baking the insulating coating in a temperature range at which thermal strain is not eliminated. Re-forming, however, leads to problems such as increased costs due to an additional process, deterioration of magnetic properties due to a worse stacking factor, and the like.

A problem also occurs in that if the damage to the coating is severe, the insulation properties and corrosion resistance cannot be recovered even by re-forming, and re-forming simply thickens the coating amount. Thickening the coating amount by re-forming not only worsens the stacking factor but also damages the adhesion property and the appearance of the steel sheet, thus significantly reducing the value of the product.

Against this background, techniques to apply strain while suppressing damage to the insulating coating have been proposed, for example in JP S62-49322 B2, JP H5-32881 B2, JP 3361709 B2, and JP 4091749 B2. Specifically, to suppress damage to the coating, the methods disclosed in JP S57-2252 B2, JP H6-072266 B2, JP S62-49322 B2, JP H5-32881 B2 and JP 3361709 B2 adopt approaches such as blurring the focus of the beam or suppressing the beam power to reduce the actual amount of thermal strain that is applied to the steel sheet. Even if the insulation properties of the steel sheet are maintained, however, the amount of iron loss reduction ends up decreasing. JP 4091749 B2 discloses a method of reducing the iron loss while maintaining insulation properties by irradiating both sides of a steel sheet with a laser. However, that method is not advantageous in terms of cost since irradiating both sides of the steel sheet increases the number of treatment steps.

It could therefore be helpful to provide a grain-oriented electrical steel sheet on which magnetic domain refining treatment by strain application has been performed, having an insulating coating with excellent insulation properties and corrosion resistance.

SUMMARY

It is essential to provide sufficient thermal strain locally on the steel sheet after final annealing to achieve reduced iron loss by magnetic domain refining treatment. The principle behind a reduction in iron loss through the application of strain is as follows.

First, upon applying strain to a steel sheet, a closure domain is generated originating from the strain. Generation of the closure domain increases the magnetostatic energy of the steel sheet, yet the 180° magnetic domain is subdivided to lower the increased magnetostatic energy, and the iron loss in the rolling direction is reduced. On the other hand, the closure domain causes pinning of the domain wall, suppressing displacement thereof, and leads to increased hysteresis loss. Therefore, strain is preferably applied locally in a range at which the effect of reducing iron loss is not impaired.

As described above, however, irradiating with a locally strong laser beam or electron beam damages the coating (forsterite film and insulating tension coating formed thereon), causing the insulation properties and corrosion resistance thereof to deteriorate greatly. Hence, pursuing a reduction in iron loss damages the coating to some degree so that worsening of the insulation properties and corrosion resistance of the coating is inevitable. However, as also described above, when the coating is damaged to a great degree, the insulation properties and corrosion resistance cannot be recovered easily even by re-forming. Intense study was therefore made of the reason why the insulation properties and corrosion resistance cannot be recovered even by re-forming.

We discovered that a steel sheet with deteriorated insulation properties and corrosion resistance after re-forming has the following characteristics.

(i) The irradiation mark region after re-forming contains defects such as multiple cracks, holes, or the like on the surface of the insulating coating.

(ii) Furthermore, the defects such as cracks, holes, or the like on the surface of the insulating coating are concentrated mainly in the central portion of the irradiation mark region.

Accordingly, we inferred that the insulation properties and corrosion resistance cannot be recovered even by re-forming due to the presence of multiple cracks, holes, or the like on the coating surface, mainly in the central portion of the irradiation mark region after re-forming. This inference coincides with the observation, during a corrosion resistance test described below, that rust easily occurs starting in the central portion of the irradiation mark region.

Therefore, we searched for a solution while re-forming insulating coatings under a variety of conditions on steel sheets on which magnetic domain refining treatment was performed under a variety of conditions. As a result, we ascertained that a grain-oriented electrical steel sheet having low iron loss and excellent insulation properties and corrosion resistance after re-forming can be manufactured by restricting the steel sheet properties after re-forming to meet the following requirements (a) to (c):

(a) In the irradiation mark region after re-forming, the ratio of the area containing defects such as cracks, holes, and the like on the surface of the insulating coating is 40% or less (b) The maximum width of the irradiation mark region in the rolling direction is 250 μm or less (c) The thickness of the insulating coating is 0.3 μm or more and 2.0 μm or less We thus provide:

(1) A grain-oriented electrical steel sheet obtained by irradiating a steel sheet with a high-energy beam so as to apply, to the steel sheet, linear strain extending in a direction that intersects a rolling direction of the steel sheet, and then re-forming an insulating coating on the steel sheet, wherein in an irradiation mark region due to the high-energy beam, a ratio of an area containing defects on the insulating coating is 40% or less, a maximum width of the irradiation mark region in the rolling direction is 250 μm or less, and a thickness of the insulating coating is 0.3 μm or more and 2.0 μm or less.

(2) The grain-oriented electrical steel sheet according to (1), wherein the direction in which the linear strain extends forms an angle of 30° or less with a direction orthogonal to the rolling direction.

(3) A method of improving iron loss properties of a grain-oriented electrical steel sheet, comprising:

irradiating a steel sheet with a high-energy beam so as to apply, to the steel sheet, linear strain extending in a direction that intersects a rolling direction of the steel sheet;

applying a coating liquid to a surface of the steel sheet after the application of the strain, the coating liquid mainly including aluminum phosphate and chromic acid and not including colloidal silica; and baking the coating liquid, under a condition of a heating rate of 50° C./s or less in a temperature region of 260° C. or more and 350° C. or less, so as to re-form an insulating coating on the steel sheet.

(4) The method of improving iron loss properties of a grain-oriented electrical steel sheet according to (3), comprising:

irradiating the steel sheet with the high-energy beam, the steel sheet being obtained by subjecting a cold-rolled sheet for grain-oriented electrical steel to primary recrystallization annealing and subsequent final annealing, wherein the cold-rolled sheet is subjected to nitriding treatment during or after the primary recrystallization annealing.

It is possible inexpensively to provide a grain-oriented electrical steel sheet, on which magnetic domain refining treatment by strain application has been performed, having a coating with excellent insulation properties and corrosion resistance.

BRIEF DESCRIPTION OF THE DRAWINGS

Our steel sheets and methods will be further described below with reference to the accompanying drawings, wherein:

FIGS. 1(*a*) and (*b*) illustrate defects on the surface of the insulating coating in an irradiation mark region.

REFERENCE SIGNS LIST $R_P$, $R_L$: Irradiation mark region
1: Insulating coating
2: Crack
3: Hole

DETAILED DESCRIPTION

As described above, in the grain-oriented electrical steel sheet, the steel sheet properties after re-forming need to be restricted to requirements (a) to (c) below. Each requirement is described in detail below.

(a) In the irradiation mark region after re-forming, the ratio of the area containing defects on the surface of the insulating coating is 40% or less (b) The maximum width of the irradiation mark region in the rolling direction is 250 μm or less (c) The thickness of the insulating coating is 0.3 μm or more and 2.0 μm or less (a) In the Irradiation Mark Region after Re-Forming, the Ratio of the Area Containing Defects on the Surface of the Insulating Coating is 40% or Less First, when using an optical microscope or an electron microscope to observe the surface of the steel sheet after irradiation with a high-energy beam such as a laser beam, electron beam, or the like, the irradiation mark region refers to a portion, within the region irradiated by the laser beam or electron beam, in which the coating has melted or peeled off. FIG. 1(*a*) shows irradiation mark regions $R_P$ in the case of spot-like irradiation, and FIG. 1(*b*) shows an irradiation mark region $R_L$ in the case of linear irradiation. Note that even after re-forming, edges of these irradiation marks can be discerned by microscope observation as long as the coating is not extremely thick. Even when edges cannot be discerned, however, the irradiation marks can be discerned with spatial mapping of Fe intensity by EPMA, or by differences in contrast in a reflected electron image.

In the above irradiation mark regions $R_P$ and $R_L$, as shown in FIGS. 1(*a*) and (*b*), it is crucial to suppress, insofar as possible, the occurrence of cracks 2 and holes 3 on the surface of the insulating coating 1 after re-forming is performed on the steel sheet to which strain has been applied. In other words, the ratio that the area containing defects such as cracks 2 and holes 3 occupies in the irradiation mark region $R_P$ or $R_L$ needs to be 40% or less.

The reason is that cracks or holes present on the surface of the insulating coating become the origin for the occurrence of rust. When such surface defects are present, the surface roughness tends to increase, which is disadvantageous when considering the insulation properties between steel sheets since electric potential concentrates at particular locations. As shown by the below-described examples, we found that if the area ratio of such defects is 40% or less, sufficient insulation properties and corrosion resistance are maintained.

Note that the cracks 2 and holes 3 are typical examples of a defect, which refers to a shape such that the surface of the insulating coating after being re-formed on the steel sheet is not smooth, and a depression or crack with a depth of 0.3 μm or more occurs on a portion of the coating surface.

The area of the defect, for example, in the case of a crack, is considered to be the area of a figure that surrounds the outermost edges of the region occupied by the crack (a region such that the peaks of a region represented as a polygon are all connected to form acute angles), as shown in FIG. 1. The area of a hole is considered to be the actual area of the hole. The ratio that the combined area of cracks and holes occupies in the area of the irradiation mark regions is defined as the area ratio of the defects on the insulating coating to the irradiation mark regions due to the high-energy beam. The above area is determined by averaging the results from observing five or more locations at 500 times magnification or greater in a sample measuring 100 mm wide by 400 mm in the rolling direction.

(b) The Maximum Width of the Irradiation Mark Region in the Rolling Direction is 250 μm or Less As shown in FIG. 1, the maximum width D of the above-defined irradiation mark region in the rolling direction is 250 μm or less. In other words, as described above, many defects such as cracks on the surface of the insulating coating after being re-formed on the steel sheet are observed to occur in the center of the irradiation mark region. The reason is believed to be that the heat input upon beam irradiation is large in the central portion of the irradiation mark, so that the cross-sectional configuration of the irradiation mark region becomes crater shaped. As a result, when applying coating liquid to the central portion, the liquid film becomes thicker in the central portion than at the edges. The reason why defects such as cracks and holes occur in the coating surface is that the surface dries and hardens first during baking, causing solvent vapor to remain within the coating. The solvent vapor then foams. When the liquid film is thick, the surface easily hardens first, easily leading to foaming and the occurrence of defects. Hence, we believe that many coating defects occur upon baking in the central portion of an irradiation mark, where the liquid film is thick.

We discovered that reducing the area of the central portion of the irradiation mark by reducing the maximum width of the irradiation mark region in the rolling direction is advantageous. The reason is that, by observation, we confirmed that even when changing the width of the irradiation mark region in the rolling direction, the width of the portion (edge) is within the irradiation mark region and which has no defect in the coating does not change greatly. Therefore, by reducing the width of the irradiation mark region, the width of the central portion can be reduced without adverse effect. We ascertained, as a result of experimenting by changing the maximum width of the irradiation mark region, that a maximum width of 250 μm or less yields coating properties such that few surface defects occur.

The maximum width is determined by averaging the results from observing five or more locations at 500 times magnification or greater in a sample measuring 100 mm wide by 400 mm in the rolling direction.

(c) The Thickness of the Insulating Coating is 0.3 μm or More and 2.0 μm or Less The thickness of the insulating coating is measured by cross-sectional observation of a steel sheet portion other than the irradiation mark region. When the insulating coating formed before beam irradiation and the re-formed insulating coating have the same composition. However, in a steel sheet irradiated with a laser beam or an electron beam, the insulating coatings are extremely difficult to distinguish. In this case, ½ of the combined thickness of the insulating tension coating and the re-formed coating is considered to be the thickness of the insulating coating formed by re-forming.

The thickness of the insulating coating is determined by averaging the results from observing five or more locations at 500 times magnification or greater in a sample measuring 100 mm wide by 400 mm in the rolling direction.

The reason why the thickness of the insulating coating is 0.3 μm or more and 2.0 μm or less is that, as described above, surface defects occur more easily when the thickness of the re-formed coating is large. The stacking factor of the steel sheet also reduces, and magnetic properties worsen. As a result of examination, the thickness of the re-formed coating needs to be 2.0 μm or less.

Furthermore, in order to recover the corrosion resistance, the thickness of the re-formed coating needs to be 0.3 μm or more.

Next, a method of manufacturing a steel sheet under the above requirements is described.

First, as a magnetic domain refinement technique, a high-energy beam such as laser irradiation or electron beam irradiation that can apply a large energy by focusing the beam diameter is adopted. As a magnetic domain refinement technique other than laser irradiation and electron beam irradiation, plasma jet irradiation is well known. However, laser irradiation or electron beam irradiation is to achieve desired iron loss.

These magnetic domain refinement techniques are described in order, starting with laser irradiation.

The form of laser oscillation is not particularly limited and may be fiber, $CO_2$, YAG, or the like, yet a continuous irradiation type laser is adopted. Pulse oscillation type laser irradiation, such as a Q-switch type, irradiates a large amount of energy at once, resulting in great damage to the coating and making it difficult to keep the irradiation mark width within the range of the present invention when the magnetic domain refinement effect is in a sufficient range.

At the time of laser irradiation, the average laser power P (W), beam scanning rate V (m/s), and beam diameter d (mm) are not particularly limited, as long as the maximum width of the irradiation mark region in the rolling direction satisfies the above requirements. Since a sufficient magnetic domain refinement effect needs to be achieved, however, the energy heat input P/V per unit length is preferably larger than 10 W·s/m. The steel sheets may be irradiated continuously or in a dot-sequence manner. A method to apply strain in a dot-sequence is realized by repeating a process to scan the beam rapidly while stopping for dots at predetermined intervals of time, continuously irradiating the steel sheet with the beam for each dot for a selected amount of time before restarting the scan. When irradiating in a dot-sequence manner, the interval between dots is preferably 0.40 mm or less since the magnetic domain refinement effect decreases if the interval is too large.

The interval in the rolling direction between irradiation rows for magnetic domain refinement by laser irradiation is unrelated to the steel sheet properties, yet to increase the magnetic domain refinement effect, this interval is preferably 3 mm to 5 mm. Furthermore, the direction of irradiation is preferably 30° or less with respect to a direction orthogonal to the rolling direction and is more preferably orthogonal to the rolling direction.

Next, conditions for magnetic domain refinement by electron beam irradiation are described.

At the time of electron beam irradiation, the acceleration voltage E (kV), beam current I (mA), and beam scanning rate V (m/s) are not particularly limited, as long as the maximum width of the irradiation mark region in the rolling direction satisfies the above requirements. Since a sufficient magnetic domain refinement effect needs to be achieved. However, the energy heat input E×I/V per unit length is preferably larger than 6 W·s/m. As for the degree of vacuum (pressure in the working chamber), the pressure in the working chamber in which the steel sheet is irradiated with the electron beam is preferably 2 Pa or less. If the degree of vacuum is lower (i.e. if pressure is greater), the beam loses focus due to residual gas along the way from the electron gun to the steel sheet, thus reducing the magnetic domain refinement effect. The steel sheets may be irradiated continuously or in a dot-sequence manner. A method to apply strain in a dot-sequence is realized by repeating a process to scan the beam rapidly while stopping for dots at predetermined intervals of time, continuously irradiating the steel sheet with the beam for each dot for a selected amount of time before restarting the scan. To implement this process with electron beam irradiation, a large capacity amplifier may be used to vary the diffraction voltage of the electron beam. When irradiating in a dot-sequence manner, the interval between dots is preferably 0.40 mm or less since the magnetic domain refinement effect decreases if the interval is too large.

The interval in the rolling direction between irradiation rows for magnetic domain refinement by electron beam irradiation is unrelated to the steel sheet properties, yet to increase the magnetic domain refinement effect, this interval is preferably 3 mm to 5 mm. Furthermore, the direction of irradiation is preferably 30° or less with respect to a direction orthogonal to the rolling direction and is more preferably orthogonal to the rolling direction.

Next, the conditions on the coating liquid composition for the re-formed insulating coating and the conditions on baking of the coating liquid are described. Conditions (i) to (iii) below need to be satisfied.

(i) Coating liquid composition: mainly includes aluminum phosphate and chromic acid, and does not include colloidal silica (ii) Baking temperature: 260° C. or more and 350° C. or less (iii) Heating rate during baking: 50° C./s or less The magnetic domain refinement effect by laser irradiation or electron beam irradiation is due to the application of thermal strain. Strain is released by baking at a high temperature, thereby reducing the magnetic domain refinement effect. Therefore, baking at approximately 500° C. or less is necessary. Furthermore, for the frequency of surface defects such as cracks or holes in the coating surface to satisfy the above-described conditions on steel sheet properties, it is necessary to prevent the surface from hardening first during baking and to prevent solvent vapor from remaining. To that end, during baking it is important that within the range in which the insulating coating forms, the temperature be low, specifically 350° C. or less, and the heating rate be low, specifically 50° C./s or less.

If the baking temperature is high, exceeding 350° C., the water used as the solvent vaporizes before evaporating from the surface, becoming the cause of defects. On the other hand, if the baking temperature is less than 260° C., the coating formation reaction does not proceed.

If the heating rate is higher than 50° C./s, the temperature distribution within the solvent becomes non-uniform, causing the surface to harden first. The lower limit on the heating rate is not particularly prescribed, but from the perspective of productivity, a lower limit of 5° C./s is preferable.

Furthermore, to lower the baking temperature, it is important that the composition of the coating liquid mainly include aluminum phosphate and chromic acid and not include colloidal silica. The reason is that since an insulating tension coating has already been applied, there is no need to include colloidal silica, which applies tension. Rather, it suffices for the re-forming to provide only insulation properties. Not including colloidal silica also allows for low-temperature baking, making it possible to maintain the effect of magnetic domain refinement due to strain application.

Other than the above points, the method of manufacturing the grain-oriented electrical steel sheet is not particularly limited, yet the following describes a recommended preferable chemical composition and a method of manufacturing.

The chemical composition may contain appropriate amounts of Al and N when an inhibitor, e.g. an AlN-based inhibitor, is used or appropriate amounts of Mn and Se and/or S when an MnS.MnSe-based inhibitor is used. Of course, these inhibitors may also be used in combination.

In this case, preferred contents of Al, N, S and Se are: Al: 0.01 mass % to 0.065 mass %; N: 0.005 mass % to 0.012 mass %; S: 0.005 mass % to 0.03 mass %; and Se: 0.005 mass % to 0.03 mass %, respectively.

Furthermore, our methods are also applicable to grain-oriented electrical steel sheets having limited contents of Al, N, S and Se without using an inhibitor.

In this case, the contents of Al, N, S and Se are preferably limited to Al: 100 mass ppm or less, N: 50 mass ppm or less, S: 50 mass ppm or less, and Se: 50 mass ppm or less, respectively.

Other basic components and optionally added components are as follows.

C: 0.08 Mass % or Less

If the C content exceeds 0.08 mass %, it becomes difficult to reduce the C content to 50 mass ppm or less, at which point magnetic aging will not occur during the manufacturing process. Therefore, the C content is preferably 0.08 mass % or less. It is not necessary to set a particular lower limit on the C content, because secondary recrystallization is enabled by a material not containing C.

Si: 2.0 Mass % to 8.0 Mass %

Silicon (Si) is an element effective in enhancing electrical resistance of steel and improving iron loss properties thereof. If the content is less than 2.0 mass %, however, a sufficient iron loss reduction effect is difficult to achieve. On the other hand, a content exceeding 8.0 mass % significantly deteriorates formability and also decreases the flux density of the steel. Therefore, the Si content is preferably 2.0 mass % to 8.0 mass %.

Mn: 0.005 Mass % to 1.0 Mass %

Manganese (Mn) is preferably added to achieve better hot workability of steel. However, this effect is inadequate when the Mn content in steel is below 0.005 mass %. On the other hand, Mn content in steel above 1.0 mass % deteriorates magnetic flux of a product steel sheet. Accordingly, the Mn content is preferably 0.005 mass % to 1.0 mass %.

Furthermore, in addition to the above basic components, the following elements may also be included as deemed appropriate to improve magnetic properties.

at least one element selected from Ni: 0.03 mass % to 1.50 mass %, Sn: 0.01 mass % to 1.50 mass %, Sb: 0.005 mass % to 1.50 mass %, Cu: 0.03 mass % to 3.0 mass %, P: 0.03 mass % to 0.50 mass %, Mo: 0.005 mass % to 0.10 mass %, and Cr: 0.03 mass % to 1.50 mass %

Nickel (Ni) is an element useful in improving the texture of a hot rolled steel sheet for better magnetic properties thereof. However, Ni content in steel below 0.03 mass % is less effective in improving magnetic properties, while Ni content in steel above 1.50 mass % makes secondary recrystallization of the steel unstable, thereby deteriorating the magnetic properties thereof. Thus, Ni content is preferably 0.03 mass % to 1.50 mass %.

In addition, tin (Sn), antimony (Sb), copper (Cu), phosphorus (P), chromium (Cr), and molybdenum (Mo) are useful elements in terms of improving magnetic properties of steel. However, each of these elements becomes less effective in improving magnetic properties of the steel when contained in steel in an amount less than the aforementioned lower limit and inhibits the growth of secondary recrystallized grains of the steel when contained in steel in an amount exceeding the aforementioned upper limit. Thus, each of these elements is preferably contained within the respective ranges thereof specified above. The balance other than the above-described elements is Fe and incidental impurities incorporated during the manufacturing process.

Steel material adjusted to the above preferable chemical composition may be formed into a slab by normal ingot casting or continuous casting, or a thin slab or thinner cast steel with a thickness of 100 mm or less may be manufactured by direct continuous casting. The slab may be either heated by a normal method of hot rolling or directly subjected to hot rolling after casting without being heated. A thin slab or thinner cast steel may be either hot rolled or directly used in the next process by omitting hot rolling. After performing hot band annealing as necessary, the material is formed as a cold rolled sheet with the final sheet thickness by cold rolling once, or two or more times with intermediate annealing therebetween. Subsequently, after subjecting the cold rolled sheet to primary recrystallization annealing (decarburizing annealing) and then final annealing, an insulating tension coating is applied, and the cold rolled sheet is subjected to flattening annealing to yield a grain-oriented electrical steel sheet with an insulating coating. Subsequently, magnetic domain refining treatment is performed by laser irradiation or electron beam irradiation of the grain-oriented electrical steel sheet. Furthermore, re-forming of the insulating coating is performed under the above requirements to yield a desired product.

During or after the primary recrystallization annealing (decarburizing annealing), to strengthen the inhibitor function, nitriding treatment may be performed with an increase in the nitrogen amount of 50 ppm or more and 1000 ppm or less. In the case of performing this nitriding treatment, when performing magnetic domain refining treatment by laser irradiation or electron beam irradiation after the nitriding treatment, damage to the coating tends to increase compared to when the nitriding treatment is not performed, and the corrosion resistance and insulation properties after the re-forming worsen significantly. Accordingly, application of our techniques is particularly effective when performing nitriding treatment. While the reason is unclear, we believe that the structure of the base film formed during final annealing changes, exacerbating exfoliation of the film.

Example 1

Cold-rolled sheets for grain-oriented electrical steel sheets, rolled to a final sheet thickness of 0.23 mm and containing Si: 3.2 mass %, Mn: 0.08 mass %, Ni: 0.01 mass %, Al: 35 ppm, Se: 100 ppm, S: 30 ppm, C: 550 ppm, O: 16 ppm, and N: 25 ppm were decarburized. After primary recrystallization annealing, an annealing separator containing MgO as the primary component was applied, and final annealing including a secondary recrystallization process and a purification process was performed to yield grain-oriented electrical steel sheets with a forsterite film. The below-described coating liquid A was then applied to the steel sheets, and an insulating coating was formed by baking at 800° C. Subsequently, magnetic domain refining treatment was applied by performing continuous laser irradiation linearly with a fiber laser, or electron beam irradiation in a dot-sequence manner at intervals of 0.32 mm between dots, on the insulating coating in a direction perpendicular to the rolling direction, and at 3 mm intervals in the rolling direction. Table 1 lists the irradiation conditions for a continuous laser, whereas Table 2 lists the irradiation conditions for an electron beam. As a result, material with a magnetic flux density $B_8$ of 1.92 T to 1.94 T was obtained.

Next, under the conditions listed in Table 1 and Table 2, re-forming of the insulating coating was performed on both sides of the steel sheets. The following two types of coating liquid were prepared and were applied separately.

Coating liquid A: liquid containing 100 cc of 20% aqueous dispersion of colloidal silica, 60 cc of 50% aqueous solution of aluminum phosphate, 15 cc of approximately 25% aqueous solution of magnesium chromate, and 3 g of boric acid Coating liquid B: liquid containing 60 cc of 50% aqueous solution of aluminum phosphate, 15 cc of approximately 25% aqueous solution of magnesium chromate, 3 g of boric acid, and 100 cc of water (not including colloidal silica)

Subsequently, the interlaminar resistance/current, withstand voltage, moist rust ratio, and 1.7 T, 50 Hz iron loss $W_{17/50}$ were measured in a single sheet tester (SST). Table 1 and Table 2 list the measurement results. Note that measurement of the interlaminar resistance/current, withstand voltage, and moist rust ratio was performed as follows.

Interlaminar Resistance/Current

Measurement was performed in conformance with the A method among the measurement methods for an interlaminar resistance test listed in JIS-C2550. The total current flowing to the terminal was considered to be the interlaminar resistance/current.

Withstand Voltage

One side of an electrode was connected to an edge of a sample steel substrate, and the other side connected to a pole with 25 mm ϕ and mass of 1 kg. The pole was placed on the surface of the sample, and voltage was gradually applied thereto. The voltage at the time of electrical breakdown was then read. By changing the location of the pole placed on the surface of the sample, measurement was made at five locations. The average was considered to be the measurement value.

Moist Rust Ratio

The moist rust ratio within the irradiation mark region was calculated by visual observation after leaving the samples for 48 hours in an environment with a temperature of 50° C. and humidity of 98%.

As shown in Table 1 and Table 2, before re-forming, or after re-forming with a thin coating, the steel sheets satisfying our conditions in the irradiation mark region satisfied a shipping standard of 0.2 A or less for interlaminar resistance and 60 V or more for withstand voltage and had extremely low iron loss properties, with iron loss $W_{17/50}$ of 0.70 W/kg or less.

TABLE 1

| | Laser irradiation conditions | | | Re-forming conditions | | | | Steel sheet properties | | |
|---|---|---|---|---|---|---|---|---|---|---|
| Condition | Beam power (W) | Beam diameter (mm) | Scanning rate (m/s) | Coating liquid | Baking temperature (° C.) | Heating rate (° C./s) | Amount applied to one side ($g/m^2$) | Area ratio of cracks and holes (%) | Maximum width of irradiation mark region in rolling direction (μm) | Thickness of reformed coating (μm) |
| 1 | 150 | 0.30 | 10 | A | 450 | 30 | 4.5 | 45 | 78 | 1.0 |
| 2 | 150 | 0.30 | 10 | A | 500 | 30 | 4.5 | 50 | 75 | 1.0 |
| 3 | 150 | 0.30 | 10 | B | 250 | 30 | 1.5 | Defective baking of coating | | |
| 4 | 150 | 0.30 | 10 | B | 260 | 30 | 1.5 | 9 | 79 | 1.1 |
| 5 | 150 | 0.30 | 10 | B | 280 | 30 | 1.5 | 5 | 85 | 1.0 |
| 6 | 150 | 0.30 | 10 | B | 300 | 30 | 1.5 | 2 | 92 | 1.1 |
| 7 | 150 | 0.30 | 10 | B | 320 | 30 | 1.5 | 16 | 75 | 1.1 |
| 8 | 150 | 0.30 | 10 | B | 340 | 30 | 1.5 | 19 | 76 | 1.1 |
| 9 | 150 | 0.30 | 10 | B | 350 | 30 | 1.5 | 38 | 62 | 1.2 |
| 10 | 150 | 0.30 | 10 | B | 350 | 35 | 1.5 | 40 | 66 | 1.1 |
| 11 | 150 | 0.30 | 10 | B | 360 | 30 | 1.5 | 42 | 78 | 1.1 |
| 12 | 150 | 0.30 | 10 | B | 320 | 5 | 1.5 | 2 | 74 | 1.1 |
| 13 | 150 | 0.30 | 10 | B | 320 | 10 | 1.5 | 2 | 74 | 1.1 |
| 14 | 150 | 0.30 | 10 | B | 320 | 20 | 1.5 | 3 | 75 | 1.1 |
| 15 | 150 | 0.30 | 10 | B | 320 | 40 | 1.5 | 25 | 79 | 1.0 |
| 16 | 150 | 0.30 | 10 | B | 320 | 50 | 1.5 | 36 | 72 | 1.0 |
| 17 | 150 | 0.30 | 10 | B | 320 | 52 | 1.5 | 42 | 75 | 1.0 |
| 18 | 150 | 0.30 | 10 | B | 320 | 60 | 1.5 | 51 | 81 | 1.1 |
| 19 | 150 | 0.30 | 10 | B | 320 | 30 | 0.3 | 5 | 75 | 0.2 |
| 20 | 150 | 0.30 | 10 | B | 320 | 30 | 0.5 | 7 | 73 | 0.3 |
| 21 | 150 | 0.30 | 10 | B | 320 | 30 | 1.0 | 12 | 72 | 0.7 |
| 22 | 150 | 0.30 | 10 | B | 320 | 30 | 2.0 | 18 | 81 | 1.3 |
| 23 | 150 | 0.30 | 10 | B | 320 | 30 | 2.5 | 25 | 73 | 1.9 |
| 24 | 150 | 0.30 | 10 | B | 320 | 30 | 2.6 | 32 | 75 | 2.0 |
| 25 | 150 | 0.30 | 10 | B | 320 | 30 | 3.0 | 38 | 72 | 2.4 |
| 26 | 150 | 0.30 | 10 | B | 320 | 30 | 3.5 | 41 | 85 | 2.9 |
| 27 | 100 | 0.30 | 10 | B | 320 | 30 | 1.5 | 12 | 50 | 1.0 |
| 28 | 150 | 0.40 | 10 | B | 320 | 30 | 1.5 | 12 | 48 | 1.1 |
| 29 | 150 | 0.20 | 10 | B | 320 | 30 | 1.5 | 32 | 152 | 1.2 |
| 30 | 150 | 0.15 | 10 | B | 320 | 30 | 1.5 | 39 | 225 | 1.2 |
| 31 | 150 | 0.12 | 10 | B | 320 | 30 | 1.5 | 40 | 250 | 1.1 |
| 32 | 150 | 0.10 | 10 | B | 320 | 30 | 1.5 | 48 | 275 | 1.1 |
| 33 | 200 | 0.10 | 10 | B | 320 | 30 | 1.5 | 56 | 295 | 1.1 |
| 34 | 250 | 0.10 | 10 | B | 320 | 30 | 1.5 | 65 | 320 | 1.1 |

| | Coating properties | | | | |
|---|---|---|---|---|---|
| Condition | Interlaminar current (A) | Withstand voltage (V) | Moist rust ratio (%) | Iron loss $W_{17/50}$ (W/kg) | Notes |
| 1 | 0.31 | 108 | 80 | 0.73 | Comparative example |
| 2 | 0.38 | 82 | 80 | 0.75 | Comparative example |
| 3 | 0.65 | 12 | 100 | 0.70 | Comparative example |
| 4 | 0.03 | 162 | 5 | 0.69 | Inventive example |
| 5 | 0.02 | 178 | 5 | 0.69 | Inventive example |
| 6 | 0.01 | 195 | 0 | 0.70 | Inventive example |
| 7 | 0.04 | 168 | 5 | 0.70 | Inventive example |
| 8 | 0.04 | 175 | 5 | 0.70 | Inventive example |
| 9 | 0.06 | 180 | 0 | 0.69 | Inventive example |
| 10 | 0.16 | 112 | 5 | 0.70 | Inventive example |
| 11 | 0.25 | 51 | 30 | 0.70 | Comparative example |
| 12 | 0.00 | 198 | 0 | 0.69 | Inventive example |
| 13 | 0.01 | 185 | 0 | 0.68 | Inventive example |
| 14 | 0.01 | 174 | 0 | 0.69 | Inventive example |
| 15 | 0.03 | 165 | 5 | 0.68 | Inventive example |
| 16 | 0.08 | 142 | 5 | 0.70 | Inventive example |
| 17 | 0.22 | 52 | 75 | 0.70 | Comparative example |
| 18 | 0.35 | 42 | 80 | 0.70 | Comparative example |
| 19 | 0.18 | 62 | 90 | 0.70 | Comparative example |
| 20 | 0.02 | 183 | 0 | 0.69 | Inventive example |
| 21 | 0.03 | 187 | 0 | 0.68 | Inventive example |
| 22 | 0.03 | 172 | 0 | 0.70 | Inventive example |
| 23 | 0.03 | 159 | 5 | 0.70 | Inventive example |
| 24 | 0.05 | 127 | 5 | 0.70 | Inventive example |
| 25 | 0.18 | 55 | 20 | 0.70 | Comparative example |
| 26 | 0.22 | 75 | 15 | 0.70 | Comparative example |
| 27 | 0.02 | 192 | 0 | 0.78 | Inventive example |
| 28 | 0.00 | 195 | 0 | 0.70 | Inventive example |
| 29 | 0.17 | 63 | 5 | 0.69 | Inventive example |

TABLE 1-continued

| | | | | | |
|---|---|---|---|---|---|
| 30 | 0.19 | 62 | 5 | 0.69 | Inventive example |
| 31 | 0.19 | 60 | 5 | 0.68 | Inventive example |
| 32 | 0.41 | 15 | 90 | 0.68 | Comparative example |
| 33 | 0.42 | 12 | 95 | 0.69 | Comparative example |
| 34 | 0.58 | 9 | 95 | 0.71 | Comparative example |

TABLE 2

| | Electron beam irradiation conditions | | | Re-forming conditions | | | | Steel sheet properties | | |
|---|---|---|---|---|---|---|---|---|---|---|
| Condition | Acceleration voltage (kV) | Beam current (mA) | Scanning rate (m/s) | Coating liquid | Baking temperature (° C.) | Heating rate (° C./s) | Amount applied to one side (g/m$^2$) | Area ratio of cracks and holes (%) | Maximum width of irradiation mark region in rolling direction (μm) | Thickness of reformed coating (μm) |
| 1 | 80 | 8 | 25 | A | 500 | 30 | 4.5 | 62 | 45 | 1.0 |
| 2 | 80 | 8 | 25 | B | 260 | 30 | 1.5 | 0 | 41 | 1.2 |
| 3 | 80 | 8 | 25 | B | 320 | 30 | 1.5 | 3 | 42 | 1.1 |
| 4 | 80 | 8 | 25 | B | 350 | 30 | 1.5 | 2 | 39 | 1.1 |
| 5 | 80 | 8 | 25 | B | 360 | 30 | 1.5 | 80 | 48 | 1.2 |
| 6 | 80 | 8 | 25 | B | 320 | 50 | 1.5 | 38 | 43 | 1.1 |
| 7 | 80 | 8 | 25 | B | 320 | 60 | 1.5 | 78 | 45 | 1.2 |
| 8 | 80 | 8 | 25 | B | 320 | 30 | 0.3 | 8 | 44 | 0.2 |
| 9 | 80 | 8 | 25 | B | 320 | 30 | 3.0 | 37 | 49 | 2.4 |
| 10 | 80 | 8 | 25 | B | 320 | 40 | 2.0 | 40 | 45 | 1.9 |
| 11 | 80 | 8 | 25 | B | 320 | 30 | 3.5 | 62 | 51 | 2.9 |
| 12 | 80 | 8 | 25 | B | 320 | 40 | 1.5 | 25 | 45 | 1.0 |
| 13 | 80 | 8 | 15 | B | 320 | 30 | 1.5 | 17 | 95 | 1.1 |
| 14 | 80 | 11 | 15 | B | 320 | 30 | 1.5 | 38 | 250 | 1.1 |
| 15 | 80 | 12 | 15 | B | 320 | 30 | 1.5 | 81 | 261 | 1.1 |
| 16 | 80 | 8 | 25 | B | 350 | 30 | 0.5 | 21 | 41 | 0.3 |
| 17 | 80 | 8 | 25 | B | 350 | 30 | 2.0 | 32 | 42 | 2.0 |

| | Coating properties | | | | |
|---|---|---|---|---|---|
| Condition | Interlaminar current (A) | Withstand voltage (V) | Moist rust ratio (%) | Iron loss $W_{17/50}$ (W/kg) | Notes |
| 1 | 0.28 | 41 | 95 | 0.69 | Comparative example |
| 2 | 0.01 | 187 | 0 | 0.69 | Inventive example |
| 3 | 0.01 | 195 | 0 | 0.69 | Inventive example |
| 4 | 0.01 | 192 | 0 | 0.70 | Inventive example |
| 5 | 0.36 | 38 | 90 | 0.70 | Comparative example |
| 6 | 0.15 | 78 | 5 | 0.70 | Inventive example |
| 7 | 0.34 | 27 | 90 | 0.69 | Comparative example |
| 8 | 0.34 | 29 | 80 | 0.68 | Comparative example |
| 9 | 0.21 | 70 | 20 | 0.68 | Comparative example |
| 10 | 0.17 | 62 | 5 | 0.69 | Inventive example |
| 11 | 0.29 | 32 | 45 | 0.70 | Comparative example |
| 12 | 0.01 | 182 | 0 | 0.69 | Inventive example |
| 13 | 0.02 | 178 | 0 | 0.69 | Inventive example |
| 14 | 0.18 | 68 | 5 | 0.68 | Inventive example |
| 15 | 0.78 | 8 | 90 | 0.67 | Comparative example |
| 16 | 0.13 | 72 | 5 | 0.70 | Inventive example |
| 17 | 0.17 | 63 | 0 | 0.69 | Inventive example |

Example 2

Cold-rolled sheets for grain-oriented electrical steel sheets, rolled to a final sheet thickness of 0.23 mm and containing Si: 3 mass %, Mn: 0.08 mass %, Ni: 0.01 mass %, Al: 35 ppm, Se: 100 ppm, S: 30 ppm, C: 550 ppm, O: 16 ppm, and N: 25 ppm were decarburized. After primary recrystallization annealing, nitrogen treatment was applied by subjecting a portion of the cold-rolled sheets as a coil to batch salt bath treatment to increase the amount of N in the steel by 550 ppm. Subsequently, an annealing separator containing MgO as the primary component was applied, and final annealing including a secondary recrystallization process and a purification process was performed to yield grain-oriented electrical steel sheets with a forsterite film. The coating liquid A described above in Example 1 was then applied to the grain-oriented electrical steel sheets, and an insulating coating was formed by baking at 800° C. Subsequently, magnetic domain refining treatment was applied by performing continuous laser irradiation linearly with a fiber laser on the insulating coating in a direction perpendicular to the rolling direction, and at 3 mm intervals in the rolling direction. As a result, material with a magnetic flux density $B_8$ of 1.92 T to 1.95 T was obtained.

Furthermore, under the conditions listed in Table 3, reforming of the insulating coating was performed on both sides of the steel sheets after magnetic domain refining treatment. The two types of coating liquid (coating liquid A and B) described above in Example 1 were prepared and were applied separately. Subsequently, the interlaminar resistance/current, withstand voltage, moist rust ratio, and 1.7 T, 50 Hz iron loss $W_{17/50}$ were measured in a single sheet tester (SST). Table 3 lists the measurement results. Note that measurement of the interlaminar resistance/current, withstand voltage, and moist rust ratio was performed as described above.

Table 3 shows that for the nitriding treatment-subjected material outside of our range, both the insulation properties and corrosion resistance were worse than when not performing nitriding treatment. On the other hand, the nitriding treatment-subjected material within our range had equivalent insulation properties and corrosion resistance as when not performing nitriding treatment, demonstrating the usefulness of our compositions and methods.

TABLE 3

| | | Laser irradiation conditions | | | Re-forming conditions | | | | Steel sheet properties | | |
|---|---|---|---|---|---|---|---|---|---|---|---|
| Condition | Nitriding treatment | Beam power (W) | Beam diameter (mm) | Scanning rate (m/s) | Coating liquid | Baking temperature (° C.) | Heating rate (° C./s) | Amount applied to one side (g/m²) | Area ratio of cracks and holes (%) | Maximum width of irradiation mark region in rolling direction (μm) | Thickness of reformed coating (μm) |
| 1 | yes | 150 | 0.30 | 10 | B | 320 | 5 | 1.5 | 3 | 125 | 1.1 |
| 2 | no | | | | | | | | 2 | 75 | 1.1 |
| 3 | yes | 150 | 0.30 | 10 | A | 450 | 30 | 4.5 | 62 | 153 | 1.0 |
| 4 | no | | | | | | | | 46 | 81 | 1.0 |
| 5 | yes | 150 | 0.30 | 10 | B | 360 | 30 | 1.5 | 48 | 142 | 1.0 |
| 6 | no | | | | | | | | 40 | 76 | 1.1 |
| 7 | yes | 150 | 0.30 | 10 | B | 320 | 60 | 1.5 | 59 | 151 | 1.1 |
| 8 | no | | | | | | | | 53 | 78 | 1.1 |
| 9 | yes | 150 | 0.15 | 10 | B | 320 | 30 | 1.5 | 78 | 290 | 1.2 |
| 10 | yes | 150 | 0.20 | | | | | | 37 | 245 | 1.1 |
| 11 | no | 150 | 0.15 | | | | | | 36 | 215 | 1.1 |

| | Coating properties | | | | |
|---|---|---|---|---|---|
| Condition | Interlaminar current (A) | Withstand voltage (V) | Moist rust ratio (%) | Iron loss $W_{17/50}$ (W/kg) | Notes |
| 1 | 0.00 | 200 | 0 | 0.67 | Inventive example |
| 2 | 0.00 | 198 | 0 | 0.69 | Inventive example |
| 3 | 0.68 | 15 | 100 | 0.69 | Comparative example |
| 4 | 0.35 | 102 | 80 | 0.73 | Comparative example |
| 5 | 0.32 | 35 | 40 | 0.68 | Comparative example |
| 6 | 0.26 | 53 | 30 | 0.70 | Comparative example |
| 7 | 0.42 | 35 | 80 | 0.68 | Comparative example |
| 8 | 0.33 | 41 | 80 | 0.70 | Comparative example |
| 9 | 0.69 | 10 | 100 | 0.66 | Comparative example |
| 10 | 0.18 | 72 | 5 | 0.67 | Inventive example |
| 11 | 0.19 | 65 | 5 | 0.69 | Inventive example |

The invention claimed is:

1. A grain-oriented electrical steel sheet having an insulating coating thereon having linear strain resulting from a high-energy beam irradiation extending in a direction that intersects a rolling direction of the steel sheet, and having a re-formed insulating coating on the insulating coating, wherein in an irradiation mark region caused by the high-energy beam, a ratio of an area containing defects on the re-formed insulating coating is 40% or less, a maximum width of the irradiation mark region in the rolling direction is 250 μm or less, and a thickness of the re-formed insulating coating is 0.3 μm or more and 2.0 μm or less.

2. The grain-oriented electrical steel sheet according to claim 1, wherein the direction in which the linear strain extends forms an angle of 30° or less with a direction orthogonal to the rolling direction.

3. The grain-oriented electrical steel sheet according to claim 1, wherein a maximum width of the irradiation mark region in the rolling direction is 39 μm to 250 μm.

* * * * *